US012276064B2

(12) United States Patent
Urbini

(10) Patent No.: US 12,276,064 B2
(45) Date of Patent: Apr. 15, 2025

(54) METHOD OF DECOLORIZING FABRICS

(71) Applicant: Soko Chimica S.R.L., Florence (IT)

(72) Inventor: Matteo Alfonso Urbini, Florence (IT)

(73) Assignee: Soko Chimica S.R.L., Florence (IT)

( * ) Notice: Subject to any disclaimer, the term of this patent is extended or adjusted under 35 U.S.C. 154(b) by 479 days.

(21) Appl. No.: 17/702,907

(22) Filed: Mar. 24, 2022

(65) Prior Publication Data

US 2022/0307190 A1 Sep. 29, 2022

(30) Foreign Application Priority Data

Mar. 29, 2021 (IT) ..... 102021000007712

(51) Int. Cl.

| | |
|---|---|
| ***D06L 4/50*** | (2017.01) |
| ***D06L 4/12*** | (2017.01) |
| ***D06L 4/13*** | (2017.01) |
| ***D06P 1/66*** | (2006.01) |
| ***D06P 5/13*** | (2006.01) |
| ***D06P 5/15*** | (2006.01) |

(52) U.S. Cl.

CPC ..... *D06L 4/50* (2017.01); *D06L 4/12* (2017.01); *D06L 4/13* (2017.01); *D06P 1/66* (2013.01); *D06P 5/132* (2013.01); *D06P 5/153* (2013.01)

(58) Field of Classification Search

None

See application file for complete search history.

(56) References Cited

U.S. PATENT DOCUMENTS

| | | | | | |
|---|---|---|---|---|---|
| 2,003,928 | A | | 6/1935 | Evans et al. | |
| 5,268,002 | A | * | 12/1993 | Olson | D06P 5/153 8/102 |
| 5,366,510 | A | * | 11/1994 | Wasinger | D06P 5/155 8/111 |
| 5,370,708 | A | * | 12/1994 | Olson | D06L 4/23 8/102 |
| 5,711,764 | A | * | 1/1998 | Wasinger | D06L 1/06 8/102 |

FOREIGN PATENT DOCUMENTS

| | | | | |
|---|---|---|---|---|
| JP | 5340550 B2 | | 8/2013 | |
| WO | WO-9513415 A1 | * | 5/1995 | D06L 3/04 |
| WO | WO-2018065388 A1 | * | 4/2018 | D06P 5/153 |

OTHER PUBLICATIONS

Search Report, IT Patent Appln. No. 202100007712, Dec. 14, 2021.

* cited by examiner

*Primary Examiner* — Katie L. Hammer

(74) *Attorney, Agent, or Firm* — Quantum Patent Law Firm; Seongyoune Kang

(57) ABSTRACT

A method for localized or diffused decolorization of colored fabrics and garments by applying an accelerating substance comprising quaternary ammonium salts and subsequently treating with ozone.

20 Claims, No Drawings

METHOD OF DECOLORIZING FABRICS

TECHNICAL FIELD

The present invention relates to the field of treatments for decolorizing textile products, particularly, but not exclusively, garments made of jeans or denim fabric.

More specifically, the invention relates to a method of decolorizing or bleaching colored fabrics, in order to give such fabrics a worn and aged appearance similar to that which would be obtained after years of use.

In particular, the object of the present invention is a method for decolorizing textile products thanks to the synergistic action of a quaternary ammonium cation and ozone.

PRESENT STATUS OF THE ART

As is well known, there are different chemical products and treatment methods used both industrially and domestically for ageing textiles in order to give certain garments greater attractiveness and aesthetic value.

The aged effect is caused by a discoloration of the fabric, which, depending on the case, can be spread over the entire surface of the garment or can be localized in specific areas of the garment itself.

It should be noted that although reference is made in the following text to Jeans or denim fabric, i.e., a fabric composed of cotton, the method of the present invention can be applied to any textile product.

It should also be noted that in this text, the term textile product refers indifferently to a fabric or a ready-made garment.

In this patent text, the terms bleaching and decolorization are used interchangeably to refer to treatment processes that are capable of altering the coloring of the textile product generally by making it paler and more tending to white.

In the textile industry, methods for localized decolorization of jeans trousers, in denim or similar fabrics, have been known for a long time, i.e. methods that achieve a particularly limited decolorization of specific areas of the product.

Currently, the most commonly used bleaching method employs a potassium permanganate solution that is sprayed by an operator onto specific areas of the fabric to be treated, particularly, in the case of trousers, the knee and thigh areas. Potassium permanganate is a strong oxidizing agent that reacts with the color of the fabric, causing it to whiten and accentuating the worn and aged appearance.

However, this solution has the disadvantage of ex-posing the operator to obvious risks to his health and safety in the event of inhalation of the aerosols formed during the spraying of potassium permanganate on the fabric.

At the same time, diffuse decolorization treatments of jeans or denim textiles are known which are used to obtain a substantially homogeneous aged effect over the whole surface of the product, i.e. without significantly non-homogeneous areas.

In the currently known solutions of this kind, the textiles to be treated are placed in industrial washing machines whose washing liquid is supplemented with chemical compounds such as potassium permanganate, sodium hypochlorite, hydrogen peroxide, laccase, etc.

These solutions for the diffuse decolorization of textiles require large quantities of chemical additives in order to achieve a sufficiently strong decolorization effect. The use of these substances has a high environmental impact and the washing water must be purified to reduce the pollutant content. Another disadvantage of these processes is the high water consumption in the various washing and rinsing phases.

In order to overcome the above-mentioned problems, processes for the bleaching of textiles using ozone have been developed several years ago. The ozone is generated on site using special machinery and introduced into hermetically sealed washing machines into which the textiles to be treated are introduced; the treatment can be carried out either dry or in water.

In the case of jeans and denim fabrics, treatment with ozone provides a cleaning of the fabric from indigo redeposition and in some cases also a mild decolorization.

To enhance the bleaching effect of the ozone, the fabric is wetted with water to accelerate the oxidizing action of the ozone.

US patent application US20140068871 describes a method of decolorizing a denim fabric by wetting it with water and then subjecting it to a second ozone bath. A similar solution is described in Japanese patent application JPH04100987A.

International patent application WO2018065388A1 discloses a method of localized decolorization of a denim fabric using ozone, after soaking certain areas of the fabric with a hygroscopic substance, i.e. a substance that absorbs moisture.

In all the solutions described above, water is used to boost the oxidizing action of ozone, but the results obtained are not satisfactory. In particular, the decolorizing effect is weak or moderate and it is not possible to selectively decolorize the fabric to obtain strong color contrasts, which are currently in great demand in the fashion sector.

US application US20140068871 referred to above also describes a method of locally decolorizing a fabric by spraying water only on certain areas of the fabric before treating it in the ozone bath. However, this solution also has the same disadvantages as the other known solutions described above, i.e. that the decolorization that can be achieved by using only water as an ozone accelerator is not sufficiently pronounced. In addition, this method is not in line with the requirements of the modern textile industry, where tens or hundreds of garments are treated simultaneously in the ozone machine, but before this phase they have to be pretreated manually by spraying water on limited areas of the fabric; only a small quantity of garments at a time can be subjected to pre-treatment, with the result that at the end of this phase, before the ozone treatment, many of the garments have completely dried out, thus rendering the following ozone treatment useless.

Other treatment processes, more expensive and complicated than the previous ones, have been developed for the localized decolorization of textiles by using ozone, such as the one described in EP0554648A1 where differential bleaching is achieved by additional pre-treatments such as the application of substances blocking the decolorizing action of ozone on part of the fabric or the dyeing of the fabric with dyes having different sensitivity to ozone.

None of the methods of bleaching textiles with ozone described above achieves an ageing effect comparable to that which can be achieved with traditional treatment methods, which however use potentially harmful or polluting chemicals. In the case of selective bleaching, none of the methods described above achieves a pronounced color contrast between bleached and unbleached areas.

OBJECT AND SUMMARY OF THE INVENTION

The object of the present invention, therefore, is to provide a method of treatment with ozone for the decolorization of colored textile products, in particular denim or jeans fabrics, which is effective and fast and does not involve high water consumption.

Another important object of the present invention is to reduce the time of ozonization treatment of textile products, while providing a pronounced and effective bleaching effect.

A further object of the present invention is to provide a method of localized decolorization of textiles that is safe for the health of operators.

Not least object of the present invention is to locally decolorize a textile product by producing a strong chromatic contrast between the areas subjected to the treatment and those not decolorized.

These and other objectives, which will be clear to the expert in the field from reading the present, are achieved by a method of decolorizing textile products that involves an initial pretreatment step, in which the fabric is wetted with an accelerating substance containing a quaternary ammonium salt and then the pretreated textile product is placed in an ozonizing fluid.

Surprisingly, it has been observed that quaternary ammonium salts enhance the oxidizing action of ozone, so that when the textile product pre-treated with this accelerant is subjected to an ozonization treatment, a much more pronounced bleaching is obtained than with ozone treatment alone.

Preferably, the quaternary ammonium salt constituting such an accelerant is cetrimonium chloride, also known as cetyltrimethylammonium chloride, or hexadecyltrimethylammonium chloride or cetrimide or CTAC.

Alternatively, the quaternary ammonium salt used is benzalkonium chloride, also called alkyldimethylbenzylammonium chloride.

Conveniently, these quaternary ammonium salts are mixed with other adjuvant components, such as surfactants (wetting agents, antifoaming agents, deaerating agents, etc.), buffering substances for pH variations and any other substances useful to facilitate the application of the product.

A mixture of cetrimonium chloride and benzalkonium chloride and/or other quaternary ammonium salts may also be used.

The accelerant used in this method can be conveniently applied with a brush or soaked glove, without running the risk of creating unwanted halos and/or stains on the finished product, unlike potassium permanganate which can only be applied by spraying in the form of tiny particles due to its high reactivity. The possibility of applying the product even without spraying it on the fabric significantly reduces the risk of inhalation by the operator.

In a first version of the decolorization method object of the present invention, particularly suitable for obtaining a diffuse and substantially uniform bleaching, the textile product is placed in a bath comprising the accelerating substance based on quaternary ammonium salts, and then is at least partially dried and subsequently placed inside the ozone treatment machine.

In a second version of this method, particularly suitable for the localized decolorization of textile products, the accelerating substance is selectively applied only on some specific areas of the textile product, for example on the thigh portion and in correspondence of the knee in the case of Jeans trousers. Once the accelerating substance has been applied, the textile product is optionally dried to prevent moisture from affecting the next step, then it is introduced into the ozone machine and is subjected to the ozonation treatment, obtaining a more accentuated decolorization in the areas where the accelerating substance has been applied.

There can be different ways of applying the accelerant, for example in case of localized decolorization, the accelerant can be applied by means of a brush or soaked glove or localized spraying. In the case of diffuse application, the accelerant can be applied using rags soaked in the same substance or by spraying inside hermetic washing machines.

In both versions of the method, there may be a final step of neutralizing the residual ozone by means of a reducing product applied in the bath, or more simply by one or more rinses followed by drying.

Very advantageously, the combined action of ozone with the accelerating substance applied to the textile product, provides a more pronounced discoloration than that obtained by the methods of decolorization with ozone known so far.

In contrast to known solutions, the method of the present invention employs an accelerating substance based on ammonium salts capable of reacting with ozone either in the presence of moisture or once said substance has completely dried.

In the already known solutions, it is required a very strict planning, therefore difficult to control, of the times of execution of the various stages of the process because the decolorizing effect of the ozone varies significantly depending on the degree of residual moisture and consequently the time elapsed from the pre-treatment phase; in these solutions the accelerant used is in fact only water or a hygroscopic substance capable of attracting moisture.

Compared to known solutions, in the method object of the present invention the decolorizing effect given by the synergistic effect of ozone and quaternary ammonium salts is not affected by humidity nor by the time elapsed between the pre-treatment phase of the product and the ozonization phase, therefore the advantages that the present solution is able to achieve are obvious.

DETAILED DESCRIPTION OF AN EMBODIMENT OF THE INVENTION

In the present patent text, the term "ozonization" refers to a process of treatment with ozone that consists in placing the textile product inside a fluid enriched with ozone. In the textile industry sector, the ozonization process is carried out by putting the textile product to be treated inside a hermetic machine, similar to an industrial washing machine, inside which the ozone produced by an ozone generator is introduced. The ozonization process can take place in dry conditions, that is without using water, by pumping the ozone gas inside the machine or, alternatively, by immersing the textile product in an aqueous bath in which the ozone is dissolved.

The method object of the present invention essentially comprises the following main phases:

(a) Pre-treatment: in this first pre-treatment step, the textile product is wetted at least partially with an accelerating substance comprising quaternary ammonium salts, preferably cetrimonium chloride and/or benzalkonium chloride;

(c) Ozonization: in this phase, the pre-treated product is placed inside an ozone machine of a known type and kept there for a certain period of time immersed in an atmosphere rich in this gas.

After the pre-treatment phase (a) but before the ozonation phase (c), the following intermediate phase may optionally be performed:

(b) Drying: in this phase the textile product is dried according to known processes, in order to eliminate the humidity that could affect the next phase of the treatment with ozone.

Finally, in certain versions of the method, after the ozonization phase (c) an additional step is performed:

(d) Neutralization: in this phase, the residual ozone is neutralized by means of a known reducing product applied in the bath or by a series of successive rinses of the product, followed by further drying.

During the ozonization phase (c), the oxidizing action of the ozone combined with the accelerating substance composed of ammonium salts, applied in the previous pre-treatment phase (a), causes a decolorization of the fabric. In other words, the ammonium salt compound accentuates the bleaching action of the ozone in the areas of the fabric on which it has been applied.

The method disclosed in the present invention can be used to achieve localized decolorization of the textile product or diffuse decolorization. In the first case, the areas where the accelerant has been applied visibly exhibit more pronounced discoloration than the areas where the accelerant has not been applied. If the pre-treatment is applied diffusely over the entire textile product, a substantially uniform bleaching is obtained but more pronounced than if ozone alone were used.

Preferably the accelerating substance employed is a cetrimonium chloride solution. The percentage concentration by weight of solute is preferably between 1% and 30% although solutions with lower or higher concentrations of solute may be employed; excellent results are obtained with a 3% concentration.

In lieu of cetrimonium chloride, a solution of benzalkonium chloride or alternatively a mixture of the above compounds of quaternary ammonium salts or other quaternary ammonium salts may be used.

In some versions of the invention, said accelerating substance further comprises at least one adjuvant compound, such as a surfactant or pH buffering substance or other similar substance, useful to facilitate application to the textile product.

According to a possible version of the invention, aimed at obtaining a localized decolorization or bleaching only in some specific areas of the textile product, during the pre-treatment step (a) the quaternary ammonium salts compound is applied by an operator directly on one or more circumscribed surface areas of the textile product so that these areas, and only these areas, are soaked with said compound. In this case, the operator applies the mixture directly to the fabric using a brush or a soaked glove, or by spraying it through an airbrush, or more generally by any other method that selectively wets one or more circumscribed areas of the product in a desired manner or pattern.

In a second version of the method, during the pre-treatment phase (a) the accelerating solution is applied in a diffused way on the textile product, thus obtaining a non-localized discoloring effect, extended to the whole surface of the textile product.

The diffused application of the accelerant according to this second version of the method object of the invention, can be carried out for example by placing the textile product in an aqueous bath inside a washing machine, in whose washing liquid the same accelerant substance is dissolved.

Other alternative solutions can be used, such as the nebulization of the accelerating substance inside the drum of a washing machine by means of nozzles incorporated in the machine itself, into which the product to be treated is placed; in this case the treatment cycle does not include an aqueous bath.

Another technique that can be used to obtain a diffused surface decolorization, although with spots of greater accumulation, is that of the soaked rags. These rags, pre-cut to size, are soaked with the accelerating substance, then, after a light extraction, are put to spin together with the textile product inside a washing machine (without water bath), releasing traces of accelerating substance by contact on the surface of the product.

It should be pointed out that although reference is made in the description to a textile product, the method object of the invention can be similarly applied to a plurality of textile products which are subjected to the pre-treatment (a) simultaneously or separately and which are subsequently simultaneously subjected to the ozonation (c) and optionally, depending on the versions of the method, to the other treatments of drying (b) and neutralization (d).

The invention claimed is:

1. A method for decolorizing a textile product comprising:

(a) pre-treatment, by applying an accelerating substance comprising quaternary ammonium salts to at least a portion of said textile product; and thereafter (c) ozonation, by introducing and maintaining said textile product in an ozonating fluid in dry conditions.

2. The method of claim 1, wherein the textile product comprises denim-type coloured cotton.

3. The method of claim 2, wherein the accelerating substance comprises a solution of quaternary ammonium salts with a concentration between 1% and 30%.

4. The method of claim 3, wherein the accelerating substance comprises a solution of quaternary ammonium salts with a concentration of 3%.

5. The method of claim 2, wherein the quaternary ammonium salts comprise cetrimonium chloride.

6. The method of claim 2, wherein the quaternary ammonium salts comprise benzalkonium chloride.

7. The method of claim 1, further comprising (b) first drying of said textile product following (a) pre-treatment but prior to (c) ozonation.

8. The method of claim 7, further comprising (d) neutralization of any residual ozone remaining on the textile product following (c) ozonation, wherein (d) neutralization comprises application of a reducing compound in a bath or by subsequent rinses which is followed by a second drying step.

9. The method of claim 8, wherein (a) pre-treatment comprises selective local application of the accelerating substance on one or more circumscribed areas of the textile product.

10. The method of claim 8, wherein during (a) pre-treatment the accelerating substance is applied diffusely on the textile product by means of an aqueous bath, by nebulization or by contact with a plurality of pre-cut soaked rags.

11. The method of claim 1, further comprising (d) neutralization of any residual ozone remaining on the textile product following (c) ozonation, wherein (d) neutralization comprises application of a reducing compound in a bath or by subsequent rinses which is followed by a second drying step.

12. The method of claim 1, wherein (a) pre-treatment comprises selective local application of the accelerating substance on one or more circumscribed areas of the textile product.

13. The method of claim 12, wherein (a) pre-treatment further comprises manual application of the accelerating substance using a brush or a soaked glove or by nebulizing it with an airbrush.

14. The method of claim 1, wherein during (a) pre-treatment the accelerating substance is applied diffusely on the textile product by means of an aqueous bath, by nebulization or by contact with a plurality of pre-cut soaked rags.

15. The method of claim 1, wherein the accelerating substance comprises a solution of quaternary ammonium salts with a concentration between 1% and 30%.

16. The method of claim 15, wherein the accelerating substance comprises a solution of quaternary ammonium salts with a concentration of 3%.

17. The method of claim 1, wherein the quaternary ammonium salts comprise cetrimonium chloride.

18. The method of claim 1, wherein the quaternary ammonium salts comprise benzalkonium chloride.

19. The method of claim 1, wherein the accelerating substance comprises at least one adjuvant compound, wherein the at least one adjuvant compound facilitates application of the accelerating substance on the textile product.

20. The method of claim 19, wherein the at least one adjuvant compound comprises a surfactant or a pH-buffering substance.

* * * * *